United States Patent [19]

Yamazaki

[11] Patent Number: 4,530,210

[45] Date of Patent: Jul. 23, 1985

[54] APPARATUS FOR CONTROLLING EVAPORATED FUEL IN AN INTERNAL COMBUSTION ENGINE HAVING A SUPERCHARGER

[75] Inventor: Ryutarou Yamazaki, Tokyo, Japan

[73] Assignee: Honda Giken Kogyo K.K., Tokyo, Japan

[21] Appl. No.: 450,609

[22] Filed: Dec. 17, 1982

[30] Foreign Application Priority Data

Dec. 25, 1981 [JP] Japan ..... 56-211463

[51] Int. Cl.[3] ..... F02B 37/00; F02M 25/08

[52] U.S. Cl. ..... 60/605; 123/520

[58] Field of Search ..... 60/605; 123/518-521, 123/559

[56] References Cited

U.S. PATENT DOCUMENTS 3,913,545 10/1975 Haase et al. ..... 123/520

4,070,828 1/1978 Barres ..... 123/521 X

OTHER PUBLICATIONS

"Turbo Cycle", Popular Science, Ray Hill, Nov. 1981, pp. 60 and 65.

*Primary Examiner*—Michael Koczo

*Attorney, Agent, or Firm*—Sughrue, Mion, Zinn Macpeak & Seas

[57] ABSTRACT

An internal combustion engine is provided with a supercharger including a compressor to compress air in an intake passage leading to the combustion chamber of the engine. A canister is connected to a source of evaporated fuel. A fuel pipeline extending from the canister to the intake passage upstream of the compressor or downstream of a throttle valve transfers the evaporated fuel from the canister to the intake passage, and an air pipeline extending from the intake passage between the compressor and the throttle valve to the canister transmits a positive pressure from the intake passage to the canister.

6 Claims, 1 Drawing Figure

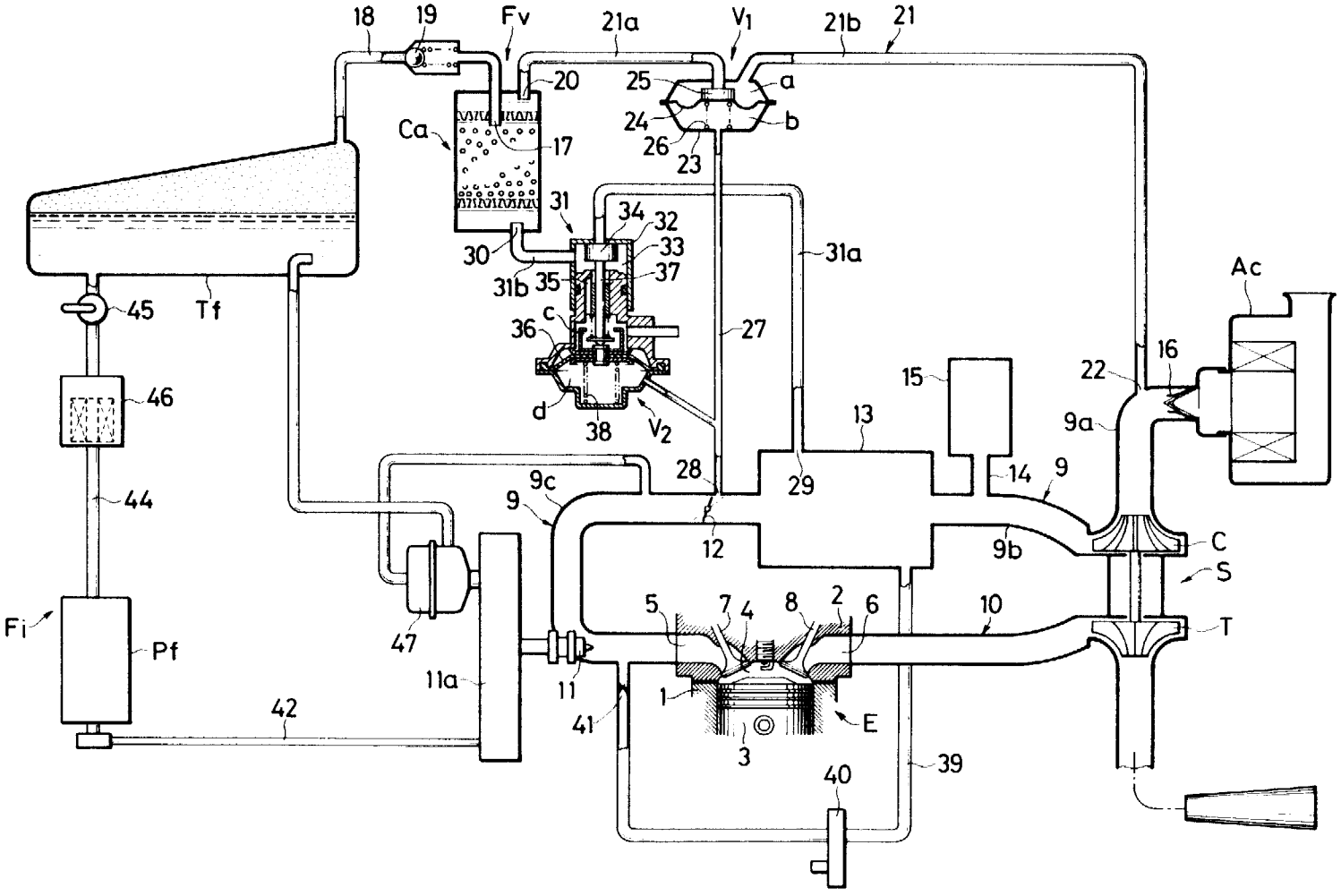
Ac
16
22
9a
C
S
T
9
14
9b
10
15
13
39
21
21b
31a
29
6
2
E
40
8
3
V1
a
b
27
4
7
12
28
23
25
24
26
5
1
21a
32
33
37
34
V2
38
41
11
20
17
31
35
c
36
d
9c
9
Fv
31b
30
11a
19
Ca
47
18
42
Tf
46
45
44
Pf
Fi

APPARATUS FOR CONTROLLING EVAPORATED FUEL IN AN INTERNAL COMBUSTION ENGINE HAVING A SUPERCHARGER

BACKGROUND OF THE INVENTION

1. Field of the Invention

This invention relates to an apparatus for supplying fuel from a canister to an intake passage in an internal combustion engine having a supercharger adapted to compress air to increase the charging efficiency of the engine and thereby improve the engine output.

2. Description of the Prior Art

In the prior art, apparatus is known for preventing evaporation of fuel from an internal combustion engine. It includes a canister adapted to absorb the fuel evaporated from a fuel tank or the like. The absorbed fuel is separated from the canister by the drawing force of a negative pressure created in the intake system of the engine during its operation, and released into the intake system to be burned in the engine.

In an internal combustion engine having a supercharger, however, a positive pressure prevails between an air compressor and a throttle valve. In order to separate fuel from a canister by utilizing a negative pressure, it is necessary to connect a fuel pipe between the canister and an intake passage downstream of the throttle valve or upstream of the compressor. If the fuel pipe is connected to the intake passage downstream of the throttle valve, however, it follows that in the event the throttle valve has a small degree of opening, a high negative pressure prevailing downstream thereof causes a large quantity of fuel to be released from the canister. Conversely, a low negative pressure causes a small quantity of fuel to be released in the event the throttle valve has a large degree of opening. Stated differently, a large quantity of fuel is released from the canister when a small quantity of air is introduced into the engine, and a small quantity of fuel is released when a large quantity of air is introduced. This may result in an increase in the quantity of harmful matter such as hydrocarbon and carbon monoxide in the exhaust gas of the engine.

If the fuel pipe is connected to the intake passage upstream of the compressor, it is impossible to obtain a desired quantity of fuel from the canister. This is because only a low negative pressure prevails in the intake passage, though the quantity of fuel released from the canister may be proportional to the quantity of air introduced into the engine.

SUMMARY OF THE INVENTION

It is therefore an object of this invention to eliminate the drawbacks of the prior art as hereinabove pointed out, and provide a novel and improved apparatus for controlling evaporated fuel in an internal combustion engine having a supercharger.

According to this invention, a positive pressure prevailing in the intake passage of the engine is utilized to pressurize a canister to thereby create an increased pressure differential between the canister and the intake passage. Evaporated fuel may then be released from the canister to the intake passage in a quantity which is proportional to the quantity of the air introduced into the engine. The evaporated fuel is supplied into the intake passage at a point which can be selected with a large degree of freedom.

Other objects and advantages of this invention will become apparent from the following detailed description and the accompanying drawing.

BRIEF DESCRIPTION OF THE DRAWING

The sole FIGURE is a diagrammatic representation of an apparatus embodying this invention.

DETAILED DESCRIPTION OF THE INVENTION

Referring to the FIGURE, there is shown an internal combustion engine E comprising a cylinder block 1, a cylinder head 2 disposed above and joined to the cylinder block 1, a piston 3 mounted slidably in the cylinder block 1, a combustion chamber 4 being defined between the cylinder head 2 and the piston 3, the cylinder head 2 defining an intake port 5 and an exhaust port 6 which are connected to the combustion chamber 4, and an intake valve 7 and an exhaust valve 8 which are adapted to open the ports 5 and 6 alternately. An intake passage 9 is connected to the outer end of the intake port 5, and an exhaust passage 10 to the outer end of the exhaust port 6. A turbo supercharger S is provided across the two passages 9 and 10.

The supercharger S is of the known type, and comprises a turbine T provided on the exhaust passage 10, and a compressor C on the intake passage 9. The turbine T and the compressor C are connected to each other for simultaneous rotation. The exhaust gas of the engine causes the turbine T to rotate, and the rotation of the turbine T is transmitted to the compressor C so that the compressor C may be driven to compress air in the intake passage 9.

A fuel injection nozzle 11 is connected to the intake passage 9 adjacent to the intake port 5. A fuel injection system Fi provides a controlled supply of fuel to the fuel injection nozzle 11 as will hereinafter be described. A throttle valve 12 is provided upstream of the nozzle 11. The intake passage 9 is partly enlarged in cross section upstream of the throttle valve 12 to define a prechamber 13. A branch 14 extends from the intake passage 9 between the prechamber 13 and the compressor C, and is connected to a resonance chamber 15.

The intake passage 9 is further provided upstream of the compressor C with a reed valve 16 for preventing the back flow of air flowing in the intake passage 9 toward the combustion chamber 4. An air cleaner Ac is connected to the inlet of the intake passage 9.

The engine is provided with a fuel vapor handling system Fv for recycling evaporated fuel from a source of evaporated fuel, such as fuel tank Tf, to the intake passage 9. The system Fv comprises a canister Ca having an inlet 17 connected to the top of the fuel tank Tf by a conduit 18 for evaporated fuel which is provided with a one-way valve 19 adapted to check the back flow of evaporated fuel from the canister Ca to the fuel tank Tf.

The canister Ca also has a fuel outlet 20 connected to one end of a fuel pipeline 21 of which the other end is connected at 22 to the intake passage 9*a* between the reed valve 16 and the compressor C. The pipeline 21 is provided with a first pressure control valve $V_1$ which divides the pipeline 21 into an upstream portion 21*a* connected to the canister Ca, and a downstream portion 21*b* leading to the intake passage 9*a*. The valve $V_1$ comprises a casing 23, a diaphragm 24 disposed in the casing 23 and dividing its interior into a positive pressure chamber a and a negative pressure chamber b, a valve member 25 provided in the positive pressure chamber a and attached to the center of the diaphragm 24, and a spring 26 urging the diaphragm 24 toward the positive pressure chamber a. The upstream portion 21*a* of the pipeline 21 has one end connected to the positive pressure chamber a, and adapted to be opened or closed by the valve member 25, while the other end thereof is connected to a canister Ca. The downstream portion 21*b* has one end connected to the positive pressure chamber a, while the other end thereof is connected to the intake passage 9*a* at 22. A negative pressure air conduit 27 has one end connected to the negative pressure chamber b, while the other end thereof is connected to an opening 28 in the intake passage 9 in the vicinity of the throttle valve 12.

If the throttle valve 12 is opened to a greater degree, as shown by a broken line in the drawing, than in its idling position which is shown by a solid line, the opening 28 introduces a negative pressure from the intake passage 9*c* downstream of the throttle valve 12 into the conduit 27. The negative pressure is transmitted into the negative pressure chamber b of the valve $V_1$, and draws the diaphragm 24 toward the negative pressure chamber b to thereby establish fluid communication between the upstream and downstream portions 21*a* and 21*b* of the fuel pipeline 21.

The canister Ca is provided at its bottom with an inlet 30 for receiving positive pressure air connected to one end of a positive pressure air pipeline 31, the other end being connected at 29 to the prechamber 13 between supercharger S and the throttle valve 12. The pipeline 31 is provided with a second pressure control valve $V_2$ which divides the pipeline 31 into an upstream portion 31*a* connected to the prechamber 13 on the intake passage 9*b*, and a downstream portion 31*b* connected to the canister Ca. The valve $V_2$ comprises a casing 32 defining a valve chamber 33 to which the upstream and downstream portions 31*a* and 31*b* of the pipeline 31 are connected, and a valve member 34 disposed in the valve chamber 33 to open or close the upstream portion 31*a* of the pipeline 31. The casing 32 further defines a diaphragm chamber connected with the valve chamber 33 by a passage 35. The diaphragm chamber is divided by a diaphragm 36 into a positive pressure chamber c and a negative pressure chamber d. The valve member 34 is connected to the diaphragm 36 by a rod 37. A spring 38 is provided in the negative pressure chamber d to urge the diaphragm 36 toward the positive pressure chamber c. The positive pressure chamber c is connected to open atmosphere, while the negative pressure chamber d is connected to the negative pressure air conduit 27.

The prechamber 13 is connected to the intake passage 9 downstream of the fuel injection nozzle 11 by a secondary air conduit 39 which is provided with an air control valve 40, and a reed valve 41 downstream of the valve 40. The air control valve 40 is actuated to supply secondary air to control the ratio of fuel and air in the intake passage 9, depending on the operation of the engine.

The fuel injection system Fi, which provides a controlled supply of fuel to the fuel injection nozzle 11, is of known construction. It comprises a fuel pump Pf having an inlet connected to the fuel tank Tf by a suction pipe 44 provided with a cock 45 and a fuel filter 46, and an outlet connected by a discharge pipe 42 to a fuel chamber 11*a* for the fuel injection nozzle 11. The fuel chamber 11*a* is connected to the fuel tank Tf by a pipe provided with a known pressure control valve 47 which is also connected to the intake passage 9*c* downstream of the throttle valve 12. The valve 47 is opened by the force of a negative pressure from the intake passage 9*c* to return a part of the fuel in the fuel chamber 11*a* to the fuel tank Tf to thereby control the pressure of the fuel in the fuel chamber 11*a* in accordance with the load bearing on the engine.

Evaporated fuel is admitted from the fuel tank Tf into the canister Ca through a conduit 18 and the one-way valve 19, and stored therein by adsorption. When the engine is not in operation, the canister Ca is maintained in communication with the open atmosphere through the downstream portion 31*b* of the pipeline 31 and the second pressure control valve $V_2$, since as shown in the drawing, the valve member 34 closes the upstream portion 31*a*.

If the engine is placed in operation, the exhaust gas discharged from the combustion chamber 4 into the exhaust passage 10 during the exhaust stroke of the engine causes the turbine T to rotate, and the rotation of the turbine is transmitted to drive the compressor C. The air drawn into the intake passage 9*a* through the air cleaner Ac and the reed valve 16 is compressed by the compressor C, and compressed air is delivered into the prechamber 13. The air is further conveyed at a flow rate controlled by the throttle valve 12, and mixed with the fuel injected by the nozzle 11, with the resulting fuel-air mixture supplied into the combustion chamber 4 during the suction stroke of the engine. Any pressure pulsation that may occur in the intake passage 9 due to the intermittent action of the intake valve 7 during the operation of the engine is damped by the prechamber 13 and the resonance chamber 15, whereby it is possible to prevent any surging of the compressor C and improve the charging efficiency of the engine.

During the idling operation of the engine, the throttle valve 12 is in its idling position as shown by a solid line in the drawing, and therefore, the opening 28 of the negative pressure conduit 27 is connected to the intake passage 9*b* upstream of the throttle valve 12. No negative pressure is transmitted to the first or second pressure control valves $V_1$ and $V_2$ through the conduit 27, but those valves are in their closed position as shown in the drawing. The canister Ca remains in communication with atmosphere, and adsorbs evaporated fuel from the fuel tank Tf.

If the engine is switched from idling to normal operation with the throttle valve 12 opened to a greater degree, as shown by the broken line in the drawing, the opening 28 of the conduit 27 is connected to the intake passage 9*c* downstream of the throttle valve 12. Consequently, a negative pressure is transmitted through the conduit 27 into the negative pressure chambers b and d of the first and second pressure control valves $V_1$ and $V_2$, respectively. In the valve $V_1$, the diaphragm 24 is drawn against the force of the spring 26 to displace the valve member 25 to establish fluid communication through the pipeline 21 so that the adsorbed fuel of the canister Ca may be delivered through the pipeline 21 into the intake passage 9*a* between the reed valve 16 and the supercharger S. In the valve $V_2$, the diaphragm 36 is drawn against the force of the spring 38 to displace the valve member 34 downwardly to thereby establish fluid communication through the pipeline 31, and close the passage 35 connecting the canister Ca to the open air.

Fluid communication is established by the pipeline 31 between the prechamber 13 on the intake passage 9*b* and the canister Ca. Air having a positive pressure flows from the prechamber 13 into the canister Ca, and pressurizes the canister Ca. As a result, a large pressure differential develops between the canister Ca and the intake passage 9a upstream of the supercharger S. Accordingly, fuel can be released effectively from the canister Ca into the intake passage 9a, even if a substantially positive pressure prevails in the passage 9a. The reed valve 16 serves to create a considerably high negative pressure in the intake passage 9a to maintain a large pressure difference between the canister Ca and the passage 9a. The one-way valve 19 checks transmission of a positive pressure from the canister Ca to the fuel tank Tf.

In the embodiment as hereinabove set forth, the pipeline 21 is connected to the intake passage 9a between the reed valve 16 and the supercharger S. It is also possible to connect it to any other point in the intake passage 9a between the air cleaner Ac and the supercharger S or the intake passage 9c between the throttle valve 12 and the engine E. Also, the positive pressure air pipeline 31 has been described and shown as being connected to the prechamber 13. It is possible to connect the pipeline 31 to any other point in the intake passage 9b between the supercharger S and the throttle valve 12. The supercharger S has been described and shown as being of the turbo type, but it is possible to employ any other type of supercharger. Other modifications to the system are within the scope of this invention.

According to this invention, therefore, it is possible to employ a small and inexpensive canister which is easy to install. There is no increase of harmful matter in the exhaust gas of the engine, since fuel is released from the canister into the intake passage in the quantity which is proportional to the quantity of the air introduced into the engine.

What is claimed is:

1. An internal combustion engine comprising:

a supercharger including a compressor to compress air in an intake passage leading to a combustion chamber of said engine, a canister connected to a source of evaporated fuel;

a throttle valve in said intake passage downstream of said compressor;

a fuel pipeline extending from said canister to said intake passage upstream of said compressor to transfer said evaporated fuel from said canister to said intake passage;

an air pipeline extending from said intake passage between said compressor and said throttle valve and downstream of said compressor to said canister to transmit a positive pressure from said intake passage to said canister;

a reed valve provided in said intake passage upstream of said fuel pipeline;

a first pressure control valve provided in said fuel pipeline, and connected in fluid communication to said intake passage in the vicinity of said throttle valve to open under the action of a negative pressure existing when said throttle valve is opened to a greater degree than in an idling position, whereby fuel may be delivered through said fuel pipeline; and a second pressure control valve provided in said air pipeline, and connected in fluid communication to said intake passage in the vicinity of said throttle valve to open under the action of said negative pressure to allow said positive pressure to be transmitted from said intake passage to said canister.

2. An internal combustion engine as set forth in claim 1, wherein said second pressure control valve divides said air pipeline into an upstream portion connected to said intake passage and downstream portion connected to said canister, said second pressure control valve comprising:

a casing defining a valve chamber and a diaphragm chamber therein, said upstream and downstream portions being connected to said valve chamber;

a diaphragm disposed in said diaphragm chamber to divide it into a positive pressure chamber and a negative pressure chamber;

a rod having one end connected to said diaphragm, and extending through a passage into said valve chamber; and a valve member attached to the other end of said rod and disposed in said valve chamber, said negative pressure chamber being in fluid communication to said intake passage in the vicinity of said throttle valve enabling said valve member to be displaced to permit transmission of said positive pressure through said upstream and downstream portions while said canister communicates with atmosphere through said downstream portion and said second pressure control valve when said valve member is in a position closing said upstream portion.

3. An internal combustion engine as set forth in claim 1, wherein said supercharger is a turbo type.

4. An internal combustion engine comprising:

a supercharger including a compressor to compress air in an intake passage leading to a combustion chamber of said engine, a canister connected to a source of evaporated fuel, a throttle valve in said intake passage downstream of said compressor;

a fuel pipeline extending from said canister to said intake passage to transfer said evaporated fuel from said canister to said intake passage;

an air pipeline extending from said intake passage between said compressor and said throttle valve to said canister to transmit a positive pressure from said intake passage to said canister;

a reed valve provided in said intake passage upstream of said fuel pipeline;

a first pressure control valve provided in said fuel pipeline, and connected in fluid communication to said intake passage in the vicinity of said throttle valve to open under the action of a negative pressure exiting when said throttle valve is opened to a greater degree than in an idling position, whereby fuel may be delivered through said fuel pipeline; and a second pressure control valve provided in said air pipeline, and connected in fluid communication to said intake passage in the vicinity of said throttle valve to open under the action of said negative pressure to allow said positive pressure to be transmitted from said intake passage to said canister.

5. An internal combustion engine as set forth in claim 4, wherein said supercharger is a turbo type.

6. An internal combustion engine as set forth in claim 4, wherein said second pressure control valve divides said air pipeline into an upstream portion connected to said intake passage and a downstream portion connected to said canister, said second pressure control valve comprising:

a casing defining a valve chamber and a diaphragm chamber therein, said upstream and downstream portions being connected to said valve chamber;

a diaphragm disposed in said diaphragm chamber to divide it into a positive pressure chamber and a negative pressure chamber;

a rod having one end connected to said diaphragm, and extending through a passage into said valve chamber; and a valve member attached to the other end of said rod and disposed in said valve chamber, said negative pressure chamber being in fluid communication to said intake passage in the vicinity of said throttle valve enabling said valve member to be displaced to permit transmission of said positive pressure through said upstream and downstream portions while said canister communicates with atmosphere through said downstream portion and said second pressure control valve when said valve member is in a position closing said upstream portion.

* * * * *